United States Patent [19]

Bishop et al.

[11] 4,270,436

[45] Jun. 2, 1981

[54] AMMUNITION FEED AND EJECT MECHANISM

[75] Inventors: James C. Bishop, South Burlington; Raymond A. Patenaude, Burlington, both of Vt.

[73] Assignee: General Electric Company, Burlington, Vt.

[21] Appl. No.: 2,039

[22] Filed: Jan. 8, 1979

[51] Int. Cl.[3] ..... F41D 7/04; F41D 11/30

[52] U.S. Cl. ..... 89/33 R; 89/12

[58] Field of Search ..... 89/12, 13 R, 33 R, 33 BA, 89/33 BB, 33 BC, 33 CA

[56] References Cited

U.S. PATENT DOCUMENTS

| | | | |
|---|---|---|---|
| 3,041,939 | 7/1962 | Dardick | 89/12 |
| 3,380,342 | 4/1968 | Chiabrandy | 89/12 |
| 3,834,272 | 9/1974 | Patenaude et al. | 89/12 |
| 4,114,511 | 9/1978 | Patenaude | 89/33 CA |

FOREIGN PATENT DOCUMENTS

| | | | |
|---|---|---|---|
| 20275 | of 1914 | United Kingdom | 89/13 R |

*Primary Examiner*—Stephen C. Bentley

*Attorney, Agent, or Firm*—Bailin L. Kuch

[57] ABSTRACT

This invention has the provision of a plurality of cam driven follower assemblies carried by the rotor, one for each gun bolt, for pushing a round from the feed sprocket to the gun bolt, and from the gun bolt to the exit sprocket.

5 Claims, 10 Drawing Figures

AMMUNITION FEED AND EJECT MECHANISM

BACKGROUND OF THE INVENTION

1. Field of the Invention

This invention relates to mechanisms for feeding and ejecting rounds of ammunition in automatic guns having relatively small diameter rotating barrel clusters, e.g. Gatling type guns.

This invention was made during the course of work under a contract with the Department of the Air Force.

2. Prior Art

Automatic guns having relatively small diameter rotating barrel clusters are shown in U.S. Pat. No. 3,834,272 issued to R. A. Patenaude et al on Sept. 10, 1974, and in U.S. Pat. No. 4,114,511 issued to R. A. Patenaude on Sept. 19, 1978. In such guns the gun barrels are very close to each other about the longitudinal axis of the gun and conventional systems for feeding rounds into and out of the gun are not appropriate. In a more conventional gun, such as is shown in U.S. Pat. No. 3,380,342 issued to R. E. Chiabrandy on Apr. 30, 1968, a guide bar or stationary cam is utilized to guide the flow of rounds to and from the gun bolts in conjunction with the interactions of the gun rotor and the feed and eject sprocket assemblies. This guide bar projects from the gun housing into an annular recess cut, to a depth of the gun barrel circle, into the gun rotor. The structural integrity of the gun rotor is maintained by the remaining central corre of the rotor. In a small diameter rotor where the gun barrels touch each other on the outside diameter of their chambers, there would not be any central core remaining if an annulus for such a guide bar was to be cut into the rotor. Other mechanisms, such as are shown in U.S. Pat. No. 3,733,960 issued to E. Ashley et al on May 22, 1973 and in U.S. Pat. No. 4,015,511 issued to L. R. Folsom et al on Apr. 5, 1977 are also not usable.

Therefore, an object of this invention is to provide a mechanism for feeding rounds to and from the gun bolts in a small diameter rotor.

A feature of this invention is the provision of a plurality of cam driven follower assemblies carried by the rotor, one for each gun bolt, for pushing a round from the feed sprocket to the gun bolt, and from the gun bolt to the exit sprocket.

BRIEF DESCRIPTION OF THE DRAWING

These and other objects, advantages and features of the invention will be apparent from the following specification thereof taken in conjunction with the accompanying drawing in which.

DESCRIPTION OF THE EMBODIMENT

Figure 1A:
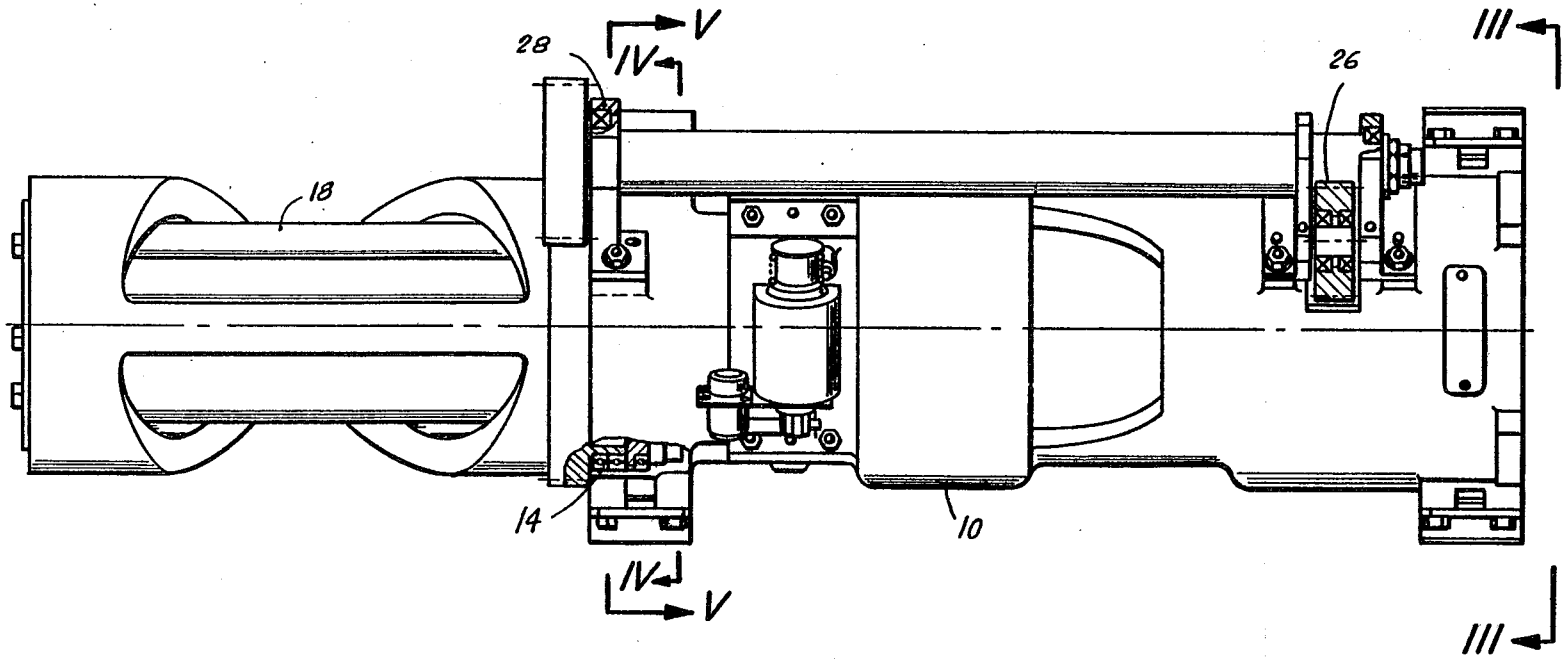
FIGS. 1A and 1B taken is conjunction are a top view of a gun incorporating an embodiment of this invention.
Figure 1B:
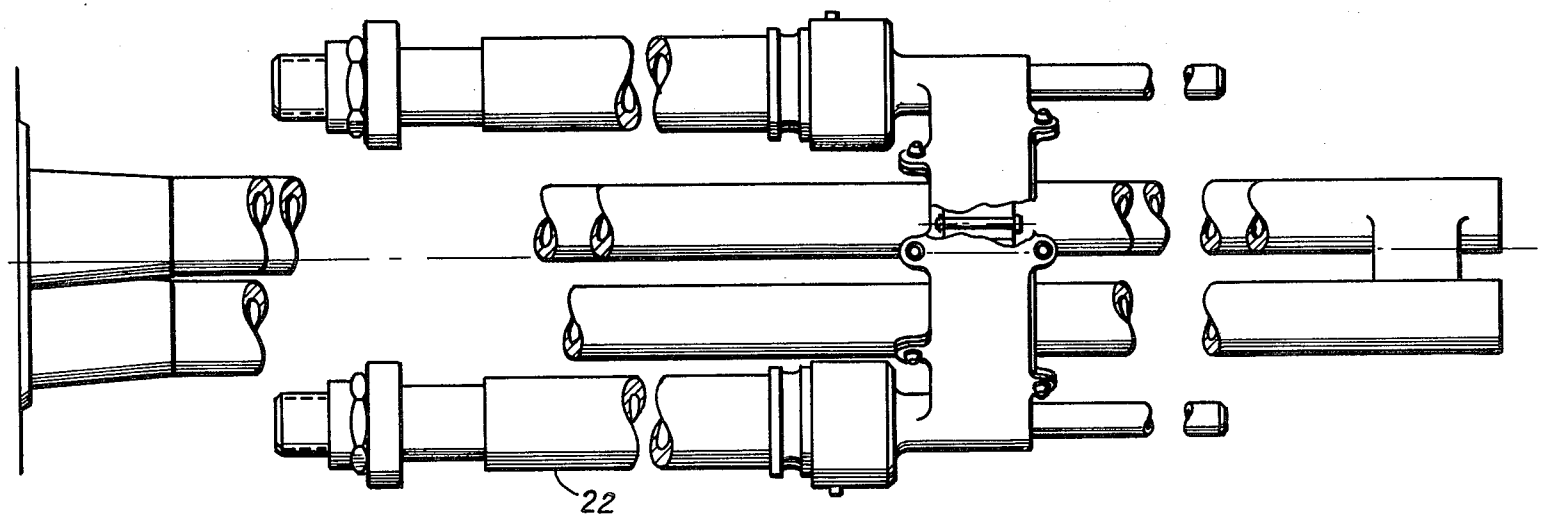
Figure 2A:
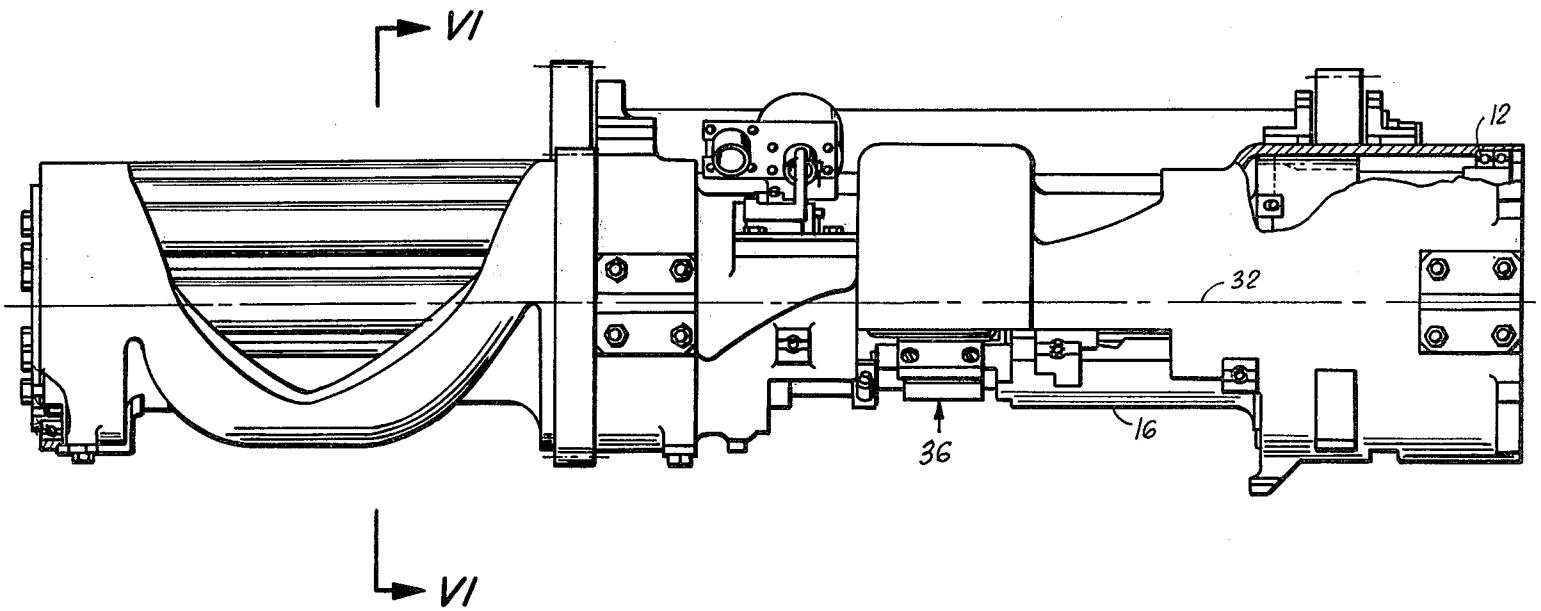
FIGS. 2A and 2B taken is conjunction are a side view of the gun of FIG. 1.
Figure 2B:
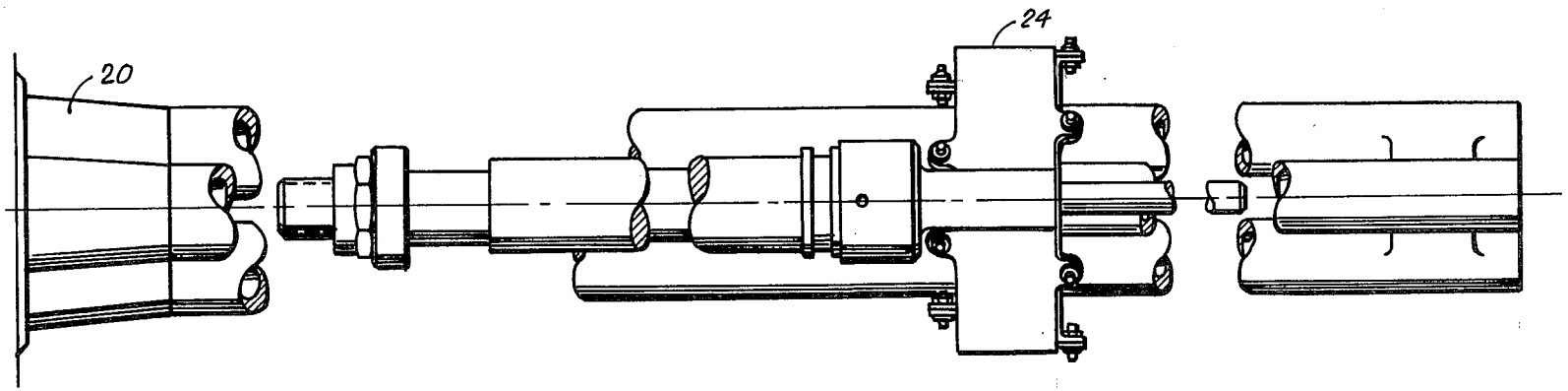
Figure 5:
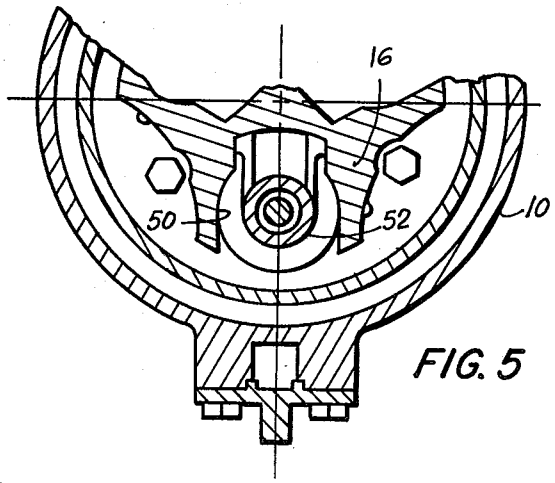
FIG. 5 is an end view in cross-section of the gun of FIG. 1 taken along the plane V—V.
Figure 6:
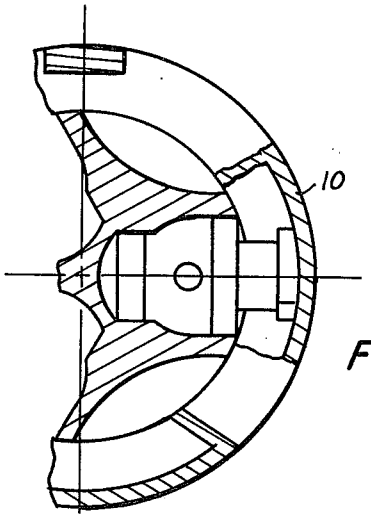
FIG. 6 is an end view in cross-section of the gun of FIG. 2 taken along the plane VI—VI.
Figure 3:
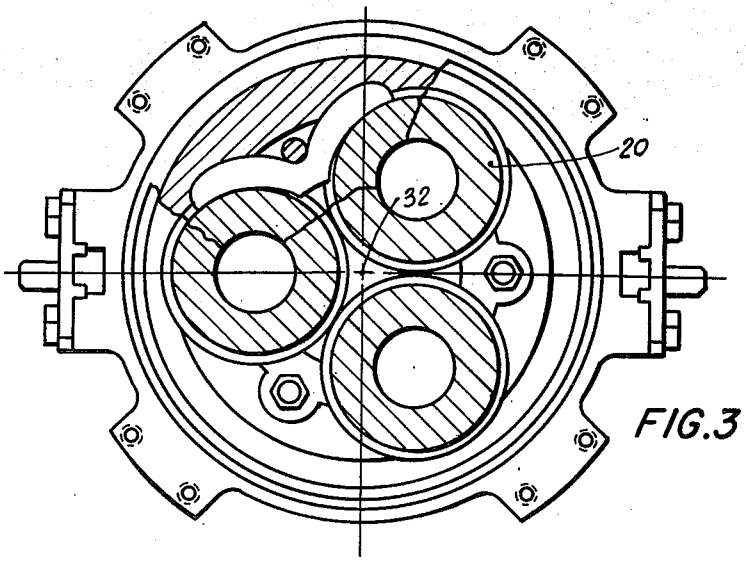
FIG. 3 is an end view in cross-section of the gun of FIG. 1 taken along the plane III—III.
Figure 4:
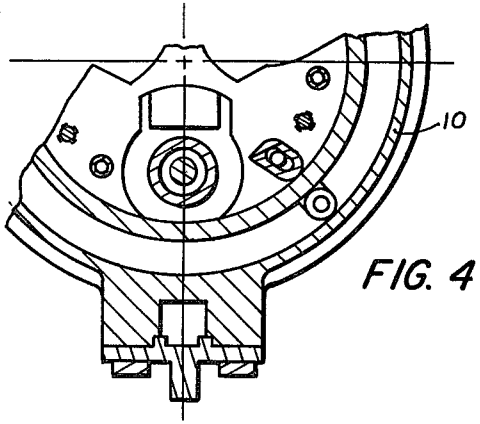
FIG. 4 is an end view in cross-section of the gun of FIG. 1 taken along the plane IV—IV.
Figure 7:
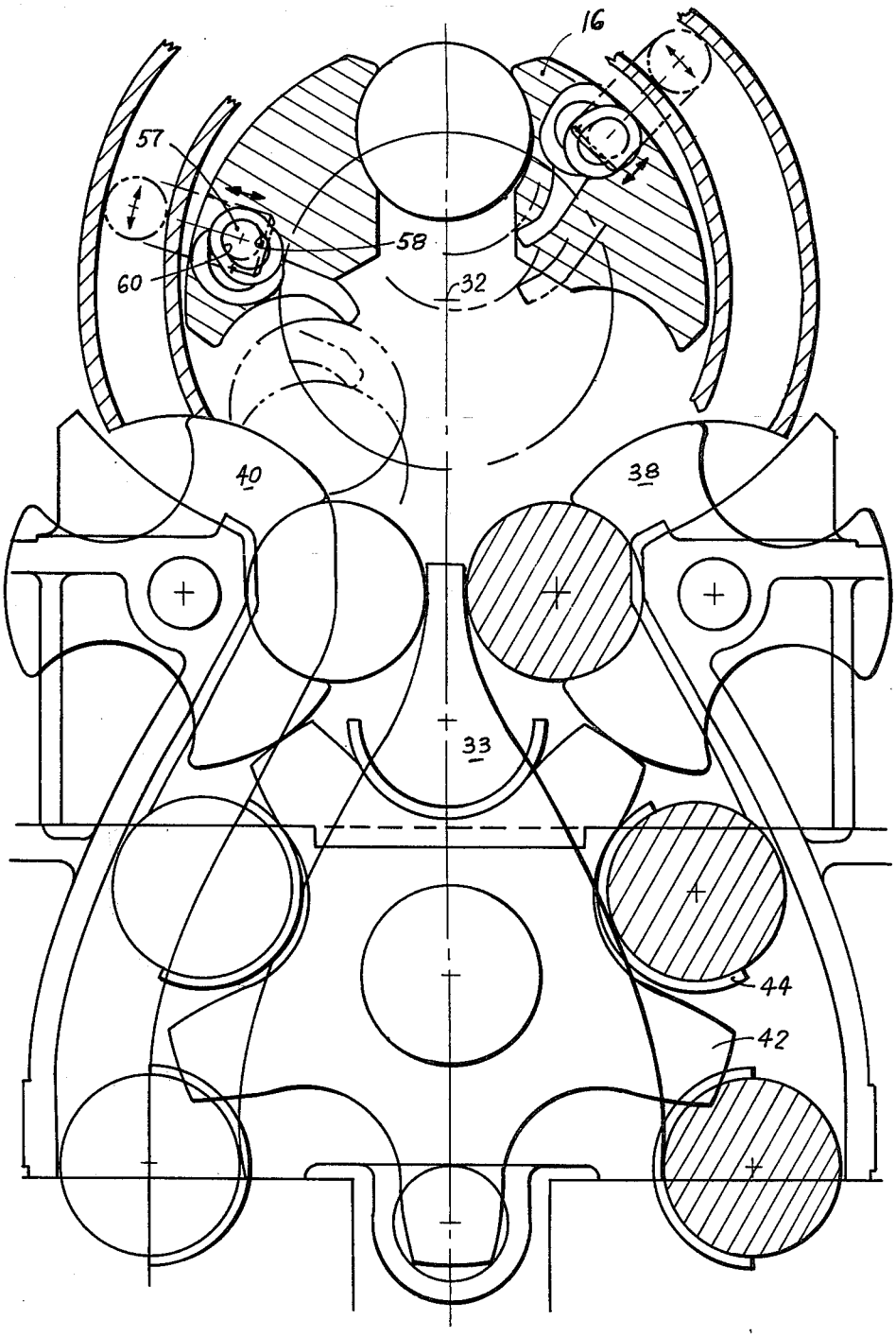
FIG. 7 is an end view in composite cross-section of the gun of FIG. 1.
Figure 8:
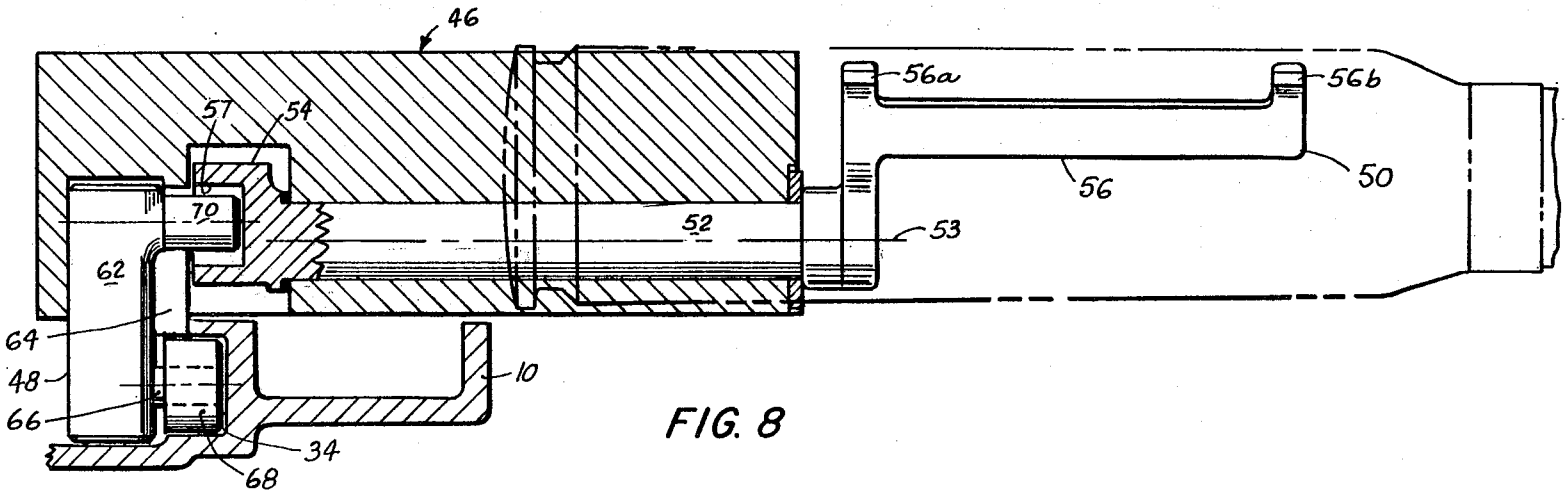
FIG. 8 is a side view of a detail of the mechanism embodying this invention in the gun of FIG. 1.

The invention is incorporated into a gun of the small diameter rotor type such as is shown in U.S. Pat. No. 3,834,272 and U.S. Pat. No. 4,114,511 and is shown in FIGS. 1 and 2. The gun includes a stationary housing 10, in which, journaled by fore and aft bearings 12 and 14, is a rotor 16, to which rotor are fixed a rotor extension 18 and three gun barrels 20. The barrels are in a tight annular row with the outside walls of the barrels touching adjacent their respective chamber areas. The gun is supported by a pair of recoil adapters 22 which are fixed between a support, not shown, and a clamp assembly 24. The clamp assembly has an outer part fixed to the recoil adapters and an inner part clamping a medial part of each of said barrels respectively, and journaled for rotation within said outer part. The gun is also supported at a forward drive support 26 and an aft drive support 28. The gun has a cam track system for driving the gun bolts.

The rotor 16 revolves about the longitudinal axis 32 of the gun within the housing 10. An annular cam track 34 is provided in the housing 10. An opening 36 is provided in the housing to permit the entrance of a feeder assembly which includes a three toothed feed sprocket 38 and a three toothed exit sprocket 40, which are journaled for rotation on respective axes which are parallel to the gun longitudinal axis 32. These sprockets are adjacent a short guide bar 33 and a turnaround sprocket 42, about which sprocket passes an endless conveyor of carriers 44, each carrier for carrying a round of ammunition or a fired cartridge case. The feed sprocket 38 hands off a round of ammunition from a carrier 44 into the rotor. The exit sprocket 40 hands off a fired case from the rotor to a carrier.

There are three rounds follower assemblies 46 carried by the rotor 16. Each assembly 46 includes a push rod 48 and a follower 50. The follower 50 includes a medial shaft portion 52, having a pivot axis 53, an aft cam portion 54, and an eccentric forward portion 56 having an aft finger **56*a* and a forward finger 56*b*. The cam portion extends longitudinally and includes a flattened cylindrical cam surface, defining a slot 57 having a first flat portion 58 for driving the fingers about the axis 53 towards the exit sprocket 40 and a second flat portion 60 for driving the fingers about the axis 53 away from the feed sprocket 38. The push rod 48 includes a rod portion 62 having a key or spline portion 64, a radially outer stud 66 onto which is journaled a cam follower wheel 68 which rides in and is driven by the cam track 34, and a radially inner stud 70 which rides in the slot 57 and either drives against the first cam surface portion or against the second cam surface portion to cause the fingers to rock about the pivot axis 53. (Alternatively, if desired, but not shown, the cam surface 60 may be formed on the exterior of the cam portion 54 and a third stud may be fixed to the rod portion 62** to drive against that cam surface.)

The rotor is provided with three radially inwardly directed slots, each to receive a respective follower assembly. Each assembly is captured in its slot by an appropriate cover plate which is fixed to the rotor.

As each gun bolt reaches its rear dwell and approaches the exit sprocket, the push rod 48, by its follower 68, is pushed radially inwardly by the housing cam track 34 and pushes its cam stud 70 against the cam track surface 58 to pivot the fingers about the axis 53 towards the exit sprocket. The tips of the fingers abut the side of the fired cartridge case to progressively push the case radially outwardly until it is received by the exit sprocket 40 and the short guide bar 33, and is ejected from the rotor to be placed on a conveyor carrier 44. The follower remains in this extended position as its gun bolt approaches the feed sprocket 38 whereat a fresh round is fed into the rotor by the feed sprocket and abuts the tips of the fingers. The housing cam track now drives the push rod 48 radially outwardly to progressively retract the fingers, permitting the feed sprocket to place the round onto the gun bolt extractor hooks under full control. The follower then stays retracted during the remainder of the gun cycle until the gun bolt comes around to ejection, at which time the follower is again driven by the housing cam.

The operation of the follower is completely reversible and allows the same positive control over fresh rounds and fired cases during reverse clearing.

What is claimed is:

1. An automatic gun including:

a housing;

a rotor journaled for rotation on a longitudinal axis in said housing;

a plurality of gun barrels secured to and rotating with said rotor;

a like plurality of gun bolts carried by and rotating with said rotor for cooperation with said plurality of gun barrels;

first means for serially providing rounds of ammunition to said gun bolts;

second means for serially receiving fired cases from said gun bolts;

a like plurality of round control means each carried by and rotating with said rotor, and each journaled for movement with respect to said rotor about a respective axis which is parallel to said longitudinal axis of said rotor, each for cooperating with a respective gun bolt, for progressively guiding the transfer of a round of ammunition from said first means to a respective gun bolt and for performing the transfer of a fired case from said respective gun bolt to said second means; and additional control means fixed to said housing and coupled to said plurality of round control means for causing the movement of each of said round control means.

2. A gun according to claim 1 wherein:

said additional control means is an annular cam track transverse to said longitudinal axis.

3. A gun according to claim 2 wherein:

each of said plurality of round control means includes a cam follower riding in said cam track.

4. An automatic gun including:

a housing;

a rotor journaled for rotation on a longitudinal axis in said housing;

a plurality of gun barrels secured to and rotating with said rotor;

a like plurality of gun bolts carried by and rotating with said rotor for cooperation with said plurality of gun barrels;

first means for serially providing rounds of ammunition to said gun bolts;

second means for serially receiving fired cases from said gun bolts;

a like plurality of round control means carried by, rotating with, and movable with respect to said rotor, each for cooperating with a respective gun bolt, for affecting the transfer of a round of ammunition from said first means to a respective gun bolt, and for affecting the transfer of a fired case from said respective gun bolt to said second means; and additional control means including an annular cam track transverse to said longitudinal axis fixed to said housing and coupled to said plurality of round control means for affecting the movement of each of said round control means;

each of said round control means includes a cam follower riding in said cam track, a shaft journaled to pivot about its longitudinal axis, means coupling said shaft to said cam follower whereby changes in radial distance of said cam follower from said longitudinal axis of said rotor cause responsive changes in the angular orientation of said shaft, and a finger fixed to and projecting transversely from said shaft for abutting the case of a round of ammunition.

5. A gun according to claim 4 wherein:

said coupling means includes a transverse cam surface fixed to said shaft, and a cam driver abutting said cam surface and fixed to said cam follower.

* * * * *